US011807995B2

(12) United States Patent
Lichtberger

(10) Patent No.: US 11,807,995 B2
(45) Date of Patent: Nov. 7, 2023

(54) TAMPING ASSEMBLY FOR A TRACK TAMPING MACHINE

(71) Applicant: HP3 Real GmbH, Vienna (AT)

(72) Inventor: Bernhard Lichtberger, Vienna (AT)

(73) Assignee: HP3 Real GmbH, Vienna (AT)

( * ) Notice: Subject to any disclaimer, the term of this patent is extended or adjusted under 35 U.S.C. 154(b) by 590 days.

(21) Appl. No.: 16/976,422

(22) PCT Filed: Feb. 28, 2019

(86) PCT No.: PCT/AT2019/050009
§ 371 (c)(1),
(2) Date: Aug. 27, 2020

(87) PCT Pub. No.: WO2019/165483
PCT Pub. Date: Sep. 6, 2019

(65) Prior Publication Data

US 2021/0002831 A1 Jan. 7, 2021

(30) Foreign Application Priority Data

Mar. 2, 2018 (AT) ..... A 50178/2018

(51) Int. Cl.
*E01B 27/16* (2006.01)

(52) U.S. Cl.
CPC ..... *E01B 27/16* (2013.01); *E01B 2203/125* (2013.01)

(58) Field of Classification Search
CPC ..... E01B 27/16; E01B 27/17; E01B 27/20; E01B 35/00; E01B 35/04; E01B 35/10;
(Continued)

(56) References Cited

U.S. PATENT DOCUMENTS 3,465,688 A * 9/1969 Sauterel ..... E01B 27/16 104/12
4,062,292 A * 12/1977 Derler ..... E01B 27/17 104/12
(Continued)

FOREIGN PATENT DOCUMENTS

CH 629552 A5 * 4/1982 ..... E01B 27/16
DE 1178099 B 9/1964
(Continued)

*Primary Examiner* — Zachary L Kuhfuss
*Assistant Examiner* — Cheng Lin
(74) *Attorney, Agent, or Firm* — Tiajoloff & Kelly LLP

(57) ABSTRACT

A tamping assembly for a track-tamping machine tamping tools designed as rocker arm pairs. Each tamping tool has a pick arm mounted on a support so as to be pivotally adjustable about a pivot axis and with a hydraulic drive engaging one end and a pick on the other end. The pick arm is of single web design and is mounted on the pivot axis between two axis supports assigned to the support. A pick holder is between the pick arm and the pick. The pick holder is mounted on the pick arm to be pivotally adjustable about an adjustment axis by a pivot drive. The adjustment axis is perpendicular to the pivot axis, and the point of attack of the hydraulic drive on the pick arm, the longitudinal axis of the pick arm, and the adjustment axis lie in a common plane between the axis supports.

13 Claims, 7 Drawing Sheets

Figure 1:
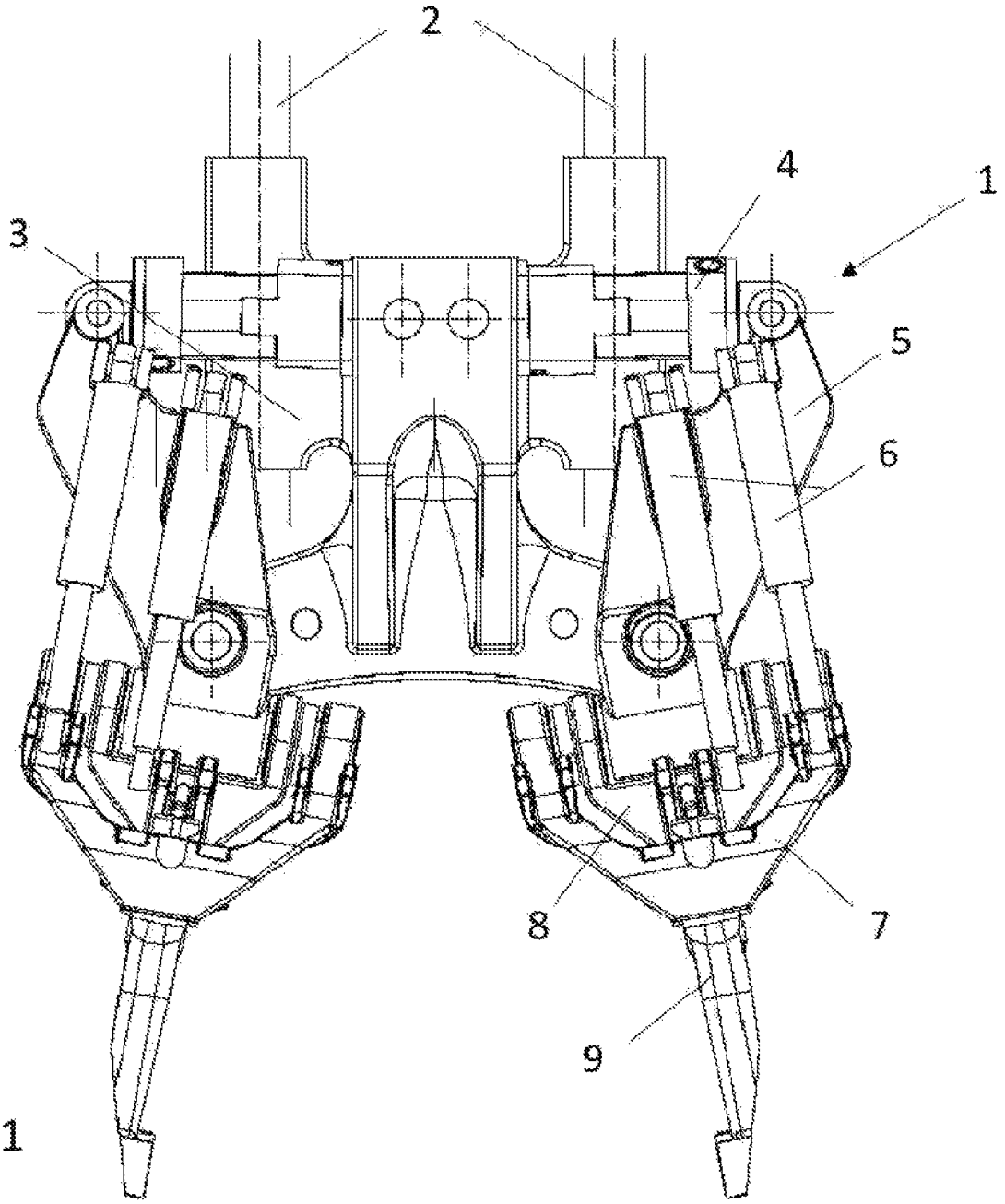

(58) Field of Classification Search
CPC ..... E01B 2203/10; E01B 2203/12; E01B 2203/122; E01B 2203/125; E01B 2203/127; E01B 29/00; E01B 29/16; E01B 29/20
See application file for complete search history.

(56) References Cited

U.S. PATENT DOCUMENTS

| | | | | | |
|---|---|---|---|---|---|
| 4,066,020 | A * | 1/1978 | Theurer | ..... | E01B 27/17 104/7.2 |
| 5,269,226 | A * | 12/1993 | Theurer | ..... | E01B 27/16 104/12 |
| 6,067,910 | A * | 5/2000 | Theurer | ..... | E01B 27/16 104/10 |
| 8,448,576 | B2 * | 5/2013 | Theurer | ..... | E01B 27/16 104/12 |
| 2011/0030573 | A1 | 2/2011 | Theurer | | |

FOREIGN PATENT DOCUMENTS

| | | | | | |
|---|---|---|---|---|---|
| DE | 2615334 | A1 | 8/1977 | | |
| DE | 202012002697 | U1 * | 8/2013 | ..... | E01B 27/16 |
| EP | 0909852 | A1 | 4/1999 | | |
| EP | 2286030 | B1 | 2/2011 | | |
| GB | 734478 | A | 8/1955 | | |
| WO | WO-2016100993 | A1 * | 6/2016 | ..... | E01B 1/001 |
| WO | 2017/115229 | A1 | 7/2017 | | |

* cited by examiner

TAMPING ASSEMBLY FOR A TRACK TAMPING MACHINE

FIELD OF THE INVENTION

The invention relates to a tamping assembly for a track-tamping machine with tamping tools pivotally adjustably arranged on a support guided in a tamping assembly frame in a height-adjustable manner and designed as rocker arm pairs, the lower tamping pick ends of which, intended for immersion in a ballast bed, are driven in opposite directions or synchronously by an oscillating drive in the form of a hydraulic drive and are hydraulically closeable relative to one another, wherein each tamping tool has a pick arm mounted on the support so as to be pivotable about a pivot axis, at one end of which pick arm the associated hydraulic drive acts, and at the other end of which pick arm at least one pick is attached, and wherein the pick arm is of single web design and is mounted on the pivot axis between two axis supports associated with the support.

DESCRIPTION OF THE PRIOR ART

Tamping assemblies use tamping tools to penetrate the ballast of a track bed in the area between two sleepers (intermediate compartment), in the area of the sleeper support in the ballast under the rail, and compact the ballast by dynamic vibration of the tamping picks between the opposing tamping picks which are closeable with respect each other. Switch tamping machines are equipped with switch tamping assemblies. Track tamping assemblies have pick arms with tamping picks firmly connected to them. Switch tamping machines, on the other hand, have pivot bearings and pick holders hinged to the pick arms with the aid of which the tamping tools can be pivoted upwards (see EP2 286 030 B1, DE 2 615 334 A1 or EP 0 909 852 B1). Tamping assemblies of the type described above with a pick arm which is formed with one web and mounted on the pivot axis between two axis supports assigned to the support are known from U.S. Pat. No. 4,062,292 A, GB 734 478 A and U.S. Pat. No. 3,465,688 A, for example. In switches, there are confined spaces not only for the rails of the continuous track but also for the outgoing track, switch drives, track control arms etc. In order to be able to tamp in places where space is limited, the outer pick or both picks can be pivoted away.

The movements of a tamping assembly include the vertical immersion of the tamping picks into the ballast, the closing movement in which the tamping pick ends are closed towards each other and the superimposed dynamic vibration which causes the actual compaction of the gravel grains. The tamping assemblies are lowered at high speed and then braked in the ballast. This results in high impact forces. During tamping, the tamping pick plates are statically pressed against the ballast front with high forces, superimposed by high dynamic sinusoidal compaction forces.

The usual designs of such switch tamping assemblies have a pick arm with two webs to which a pivot bearing is attached asymmetrically offset to the outside. When plunging into the ballast, large forces occur. During tamping itself, the pick arms, the pick arm bearing, the bearings of the pivot bearing and the pick holder, as well as the pivot bearing and the pick holder itself are subjected to high loads.

These high stresses lead to wear of the bushes and bolts used as well as the bores. Due to the usual design of the pick arm with two webs and its articulated connection with the tamping box as support, two axial seals must be installed.

The bearing itself is normally formed in an oil-lubricated manner. If there are problems with the axial seals, it is complicated to remove the pin and install new axial seals.

The wear and tear of the tamping assembly and its maintenance is associated with high costs. During one year of operation, overhaul and repair work must be carried out continuously. On average, conventional tamping assemblies have to undergo an expensive general overhaul every four years. The general overhaul of the tamping assemblies takes several weeks during which the tamping machine cannot work. This has a negative effect on the availability and reliability of the tamping machine.

SUMMARY OF THE INVENTION

The invention is thus based on the object of further developing tamping assemblies of the type described above by simple means in such a way that the stability of the entire tamping assembly, in particular with support, vertical guides, pick arms, pick arm bearings, pivot bearings and the pivot bearing bearings, pick holders and pick holder bearings, is increased.

The invention solves the set object in that a pick holder is provided between the pick arm and the pick, which is mounted on the pick arm so as to be pivotally adjustable about an adjustment axis by means of a pivoting drive, that the adjustment axis is arranged perpendicularly to the pivot axis and the point of attack of the hydraulic drive on the pick arm, the longitudinal axis of the pick arm and the adjustment axis lie in a common plane which lies between the two axis supports which are assigned to the support. Advantageous further developments of the invention can be found in the subclaims.

According to the invention, the pick arm is not designed with two webs but with only one web, which considerably simplifies the rotary bearing of the pick arm and thus eliminates the need for expensive axial seals. The embodiment in accordance with the invention considerably reduces the moments introduced into the system via the impact forces and the compression forces, which reduces the stress and the associated wear and increases the service life of the components.

A pick holder is provided between the pick arm and the pick, which is mounted in a pivotally adjustable manner about an adjustment axis with a pivot drive on the pick arm. This embodiment according to the invention considerably reduces the compressive forces on the bearing of the pick holder, which considerably increases the durability of the bushings, bolts and eyes, thus reducing maintenance costs and increasing the availability and reliability of the tamping machine.

In addition, the bearing of the pick holders is designed according to the invention to act as a single web in the direction of force and not asymmetrical, which further reduces the acting forces and moments. For this purpose, it is provided that the adjustment axis is arranged perpendicular to the pivot axis and that the point of attack of the hydraulic drive on the pick arm, the longitudinal axis of the pick arm and the adjustment axis lie in a common plane, which lies between the two axis support associated with the support.

Preferably, at least two pick holders are assigned to each pick arm, which are mounted on the pick arm so as to be pivotally adjustable about the common adjustment axis, are designed as identical parts and are preferably mounted so as to be pivotally adjustable by means of sliding bushes on the adjustment axis which is non-rotatably arranged in the pick arm.

In order to make the switch tamping assembly less maintenance-intensive, specially coated slide bushings are used at all bearing points, which have the properties of a particularly high dynamic and static strength. Pivot and/or adjustment axes can be assigned to lubricant-free slide bushings made of plastic, composite material or carbon fiber. Such bushings require neither grease nor oil lubrication and are far superior in their wear properties to the conventional lubricated bronze bushings otherwise used.

In order that other drives can also be equipped with this invention, it is advantageous if one end of the hydraulic drive, which acts on the pick arm, acts on the other end via a bearing block on the support. The bearing block for the linkage of the tamping drives is designed as a separate component for this purpose, which can be adapted and connected to the support if required.

The advantages of this embodiment according to the invention are the considerably lower wear, the longer durability of the bearings used, the omission of lubrication and the simplicity of assembly and maintenance. This saves material, repair and labor costs during assembly, overhaul or repair. The elimination of lubricants and lubrication equipment is also an advantage in terms of sustainability and reduced environmental impact. The design solution of mounting two pivotable pick holders next to each other brings the further advantage of higher pivoting capability. Outside the track, there are obstacles such as switch drive boxes against which picks that cannot be pivoted high enough will strike. The use of a pivot bearing within which the pick holder of the inner pick rotates makes it difficult to pivot the pick sufficiently high. The two pick holders of one side of the tamping assembly are identical as castings. During assembly, only one of them is rotated by 180° around the vertical axis. This reduces storage costs for the customer. Due to the identical design, both are subjected to the same load and not different as in the conventional design with pivot bearing and pick holder.

BRIEF DESCRIPTION OF THE INVENTION

Figure 2:
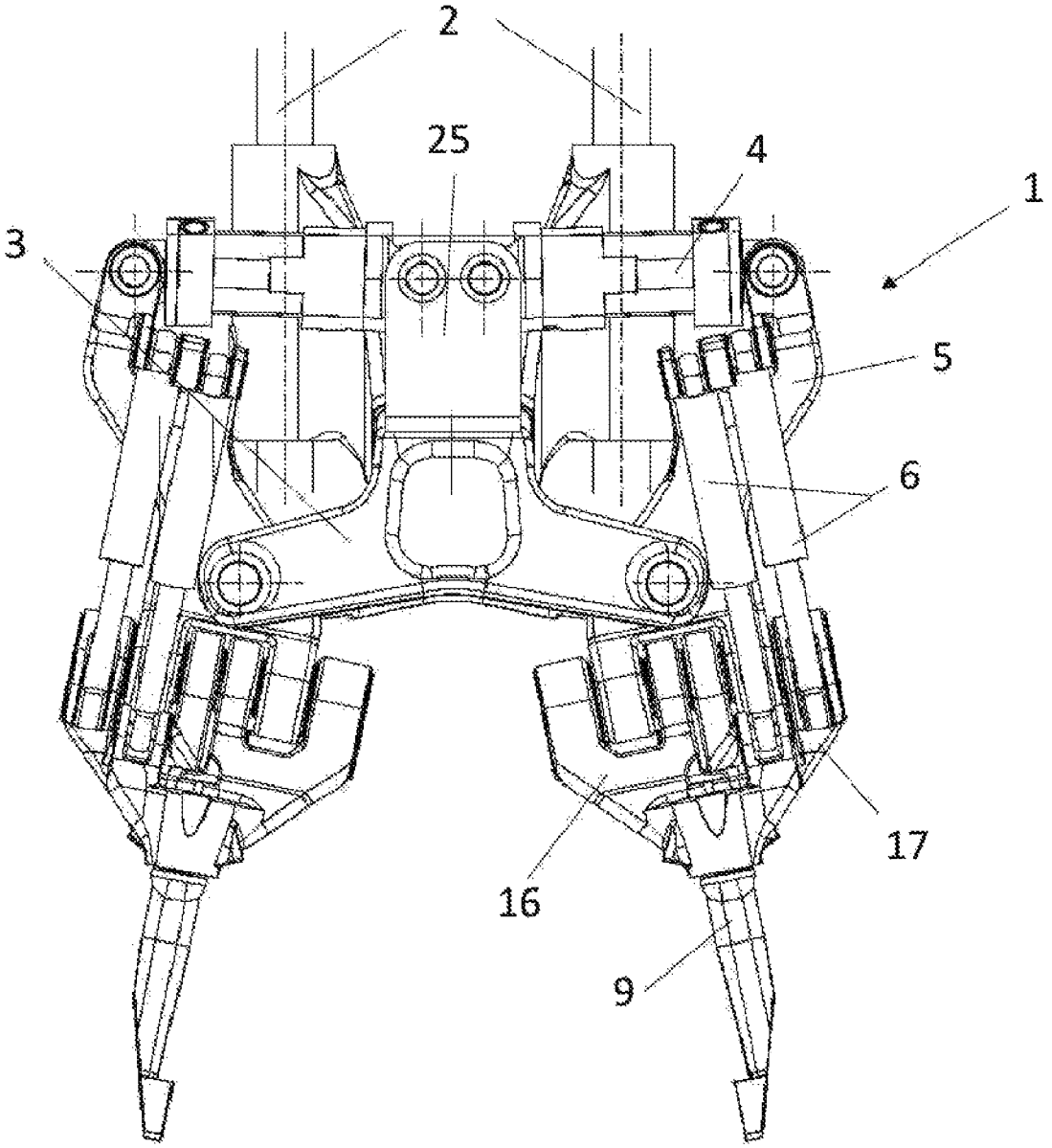
Figure 3:
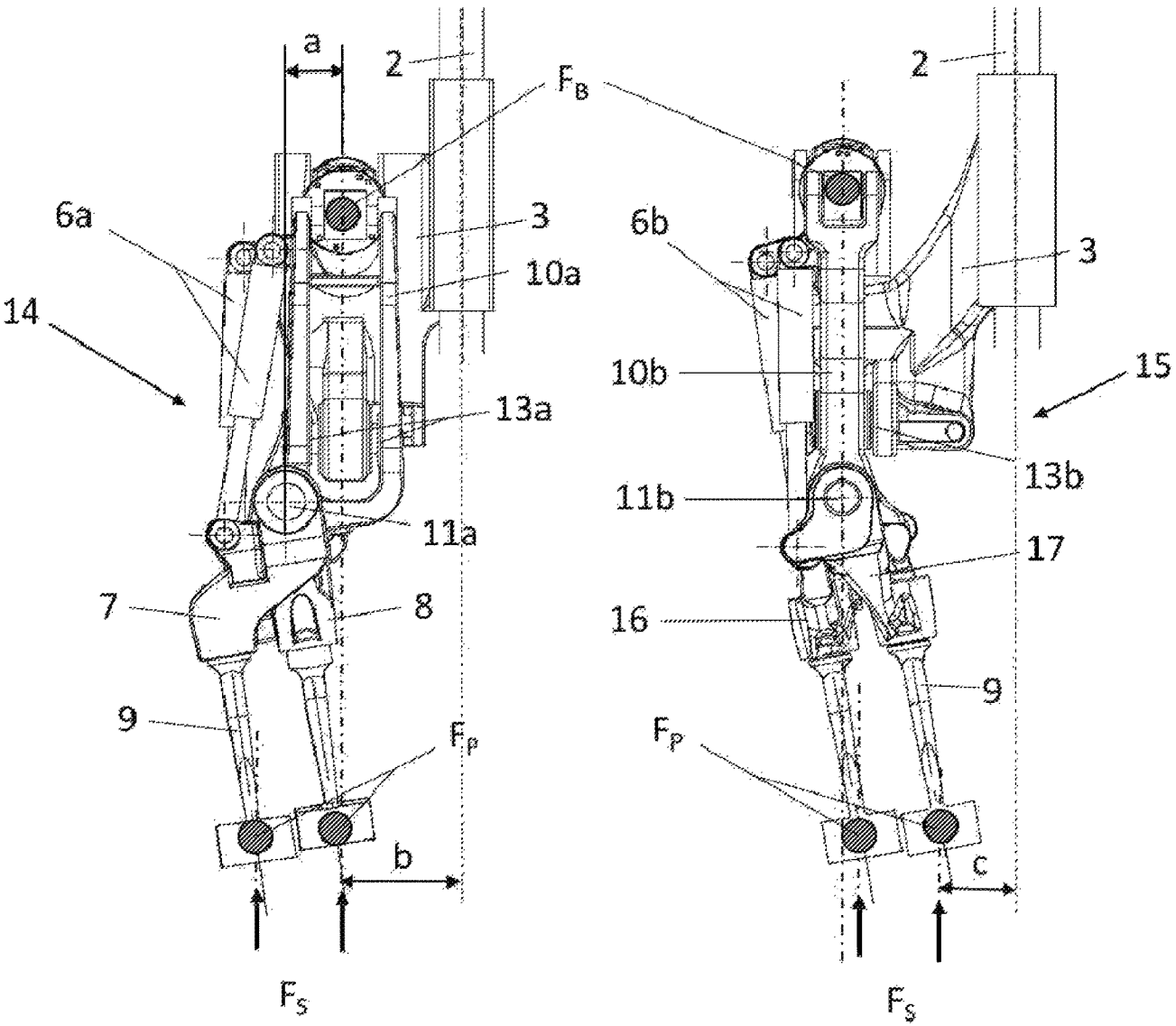
Figure 4:
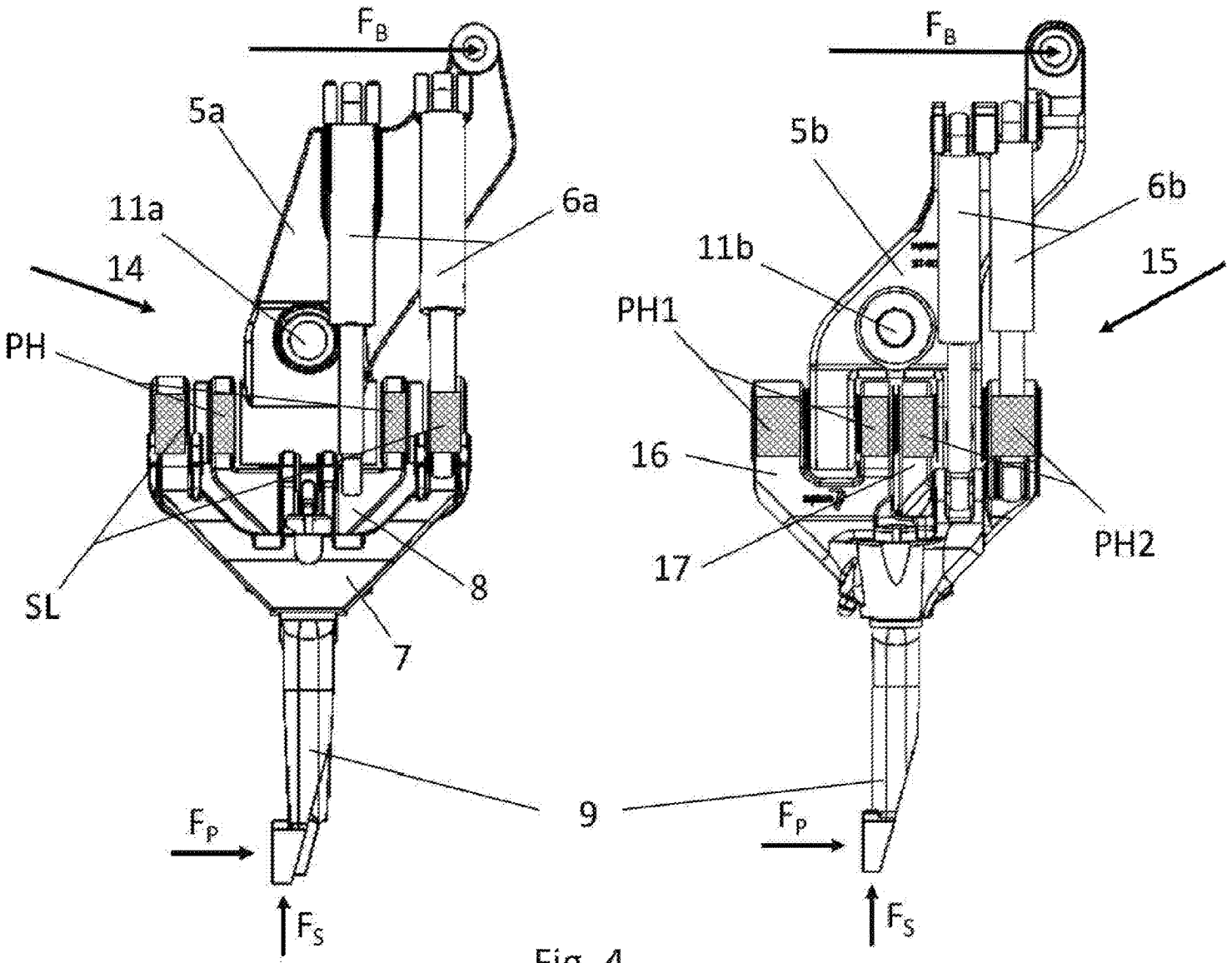
Figure 5:
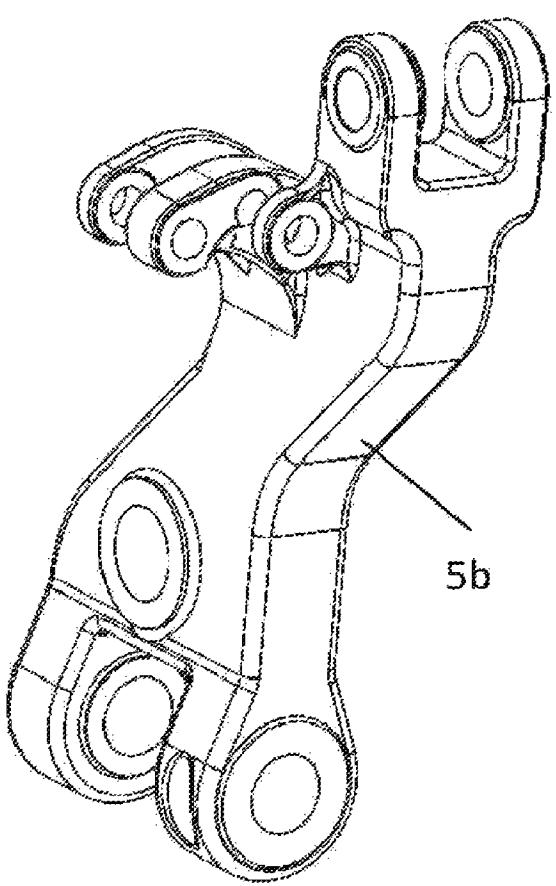
Figure 5:
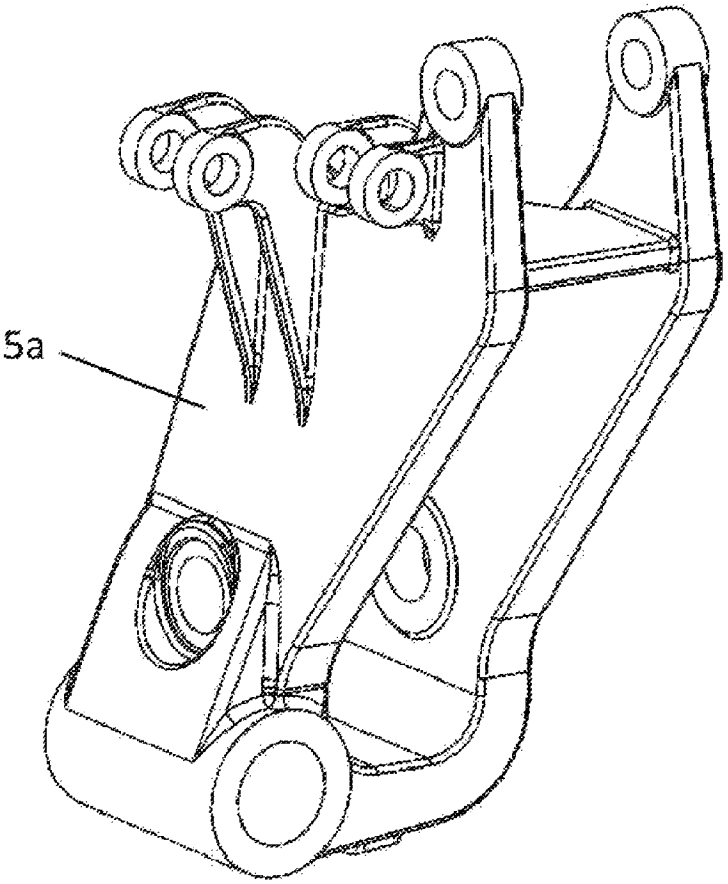
Figure 6:
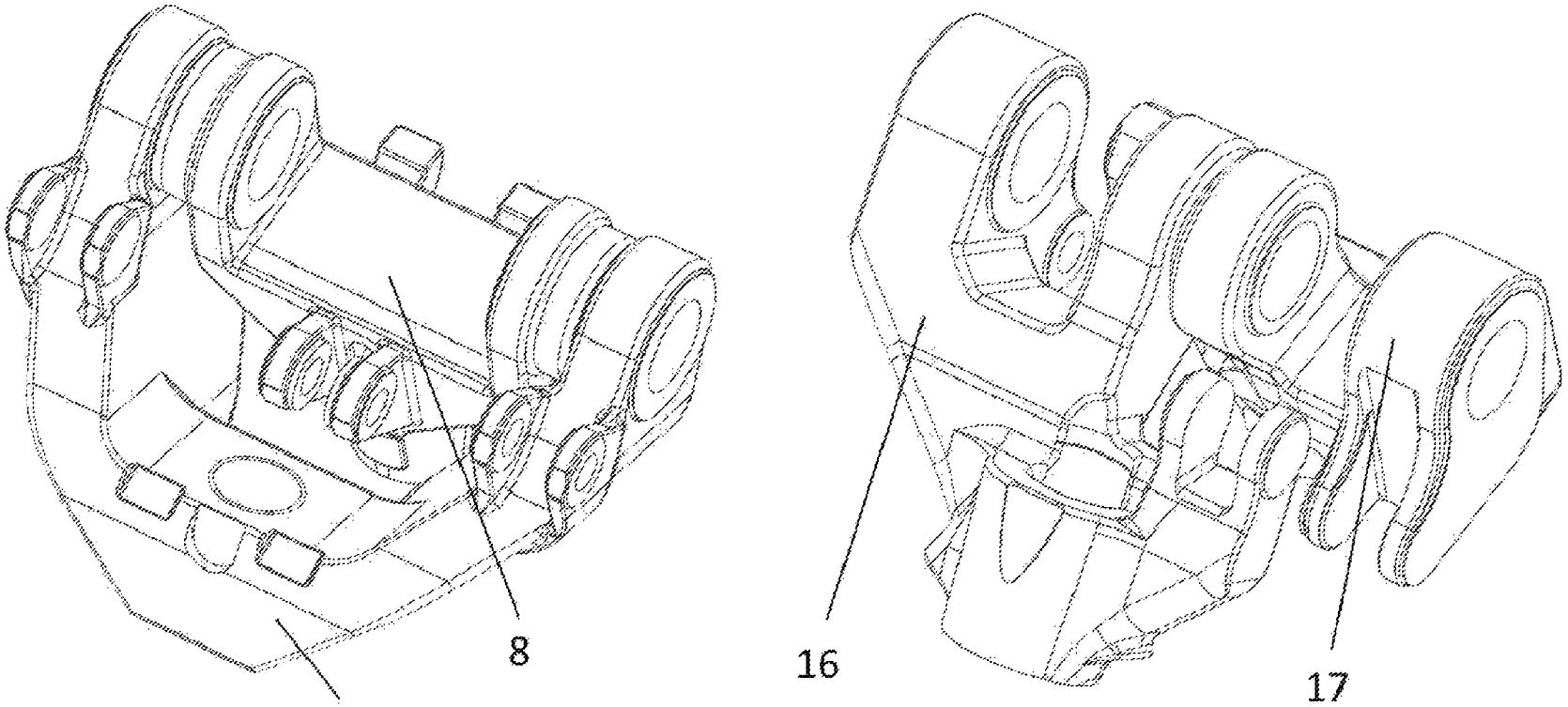
Figure 7:
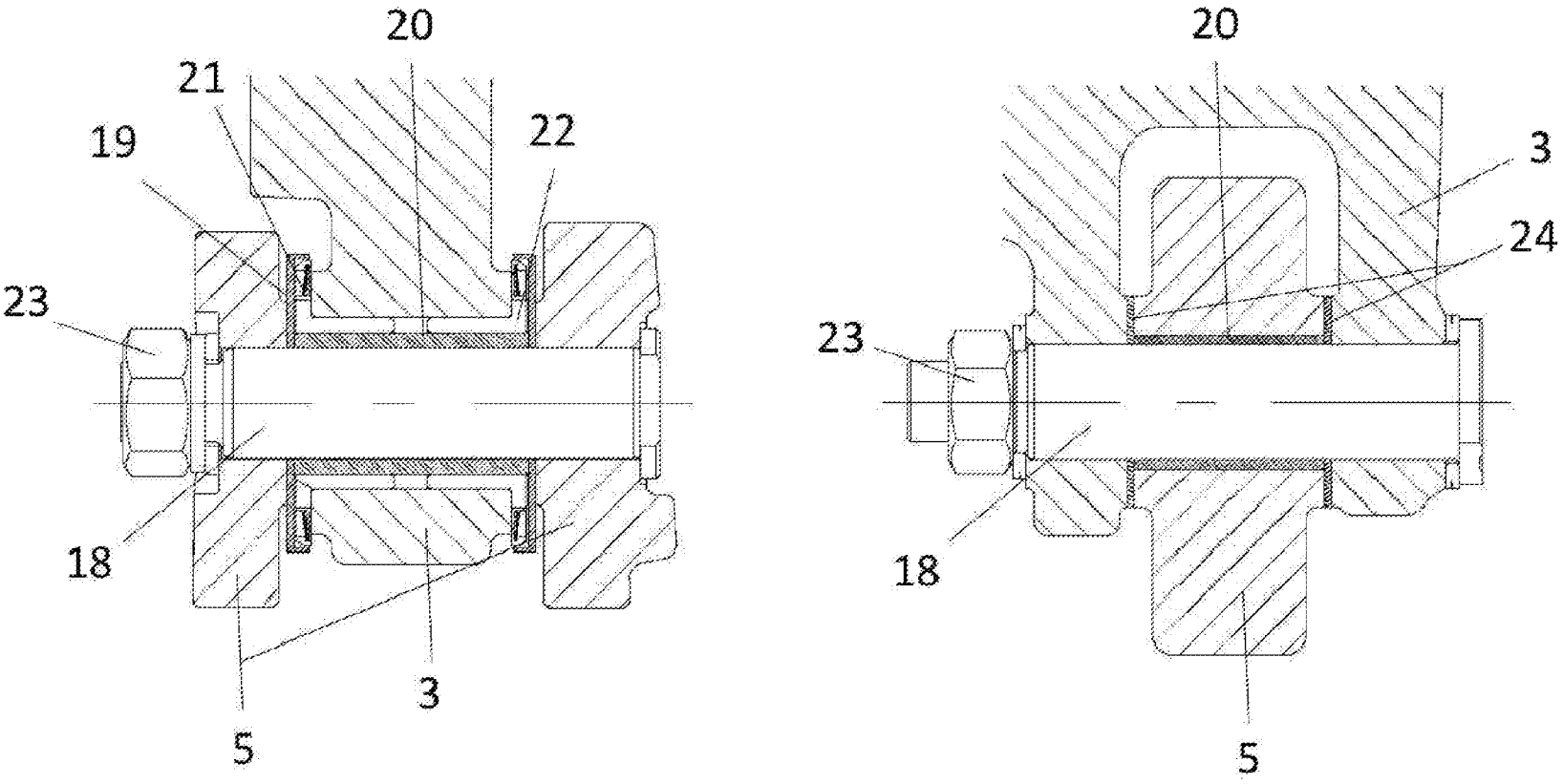

The subject matter of the invention is schematically shown in the drawings by way of example, wherein:

FIG. 1 shows a conventional (prior art) fully hydraulic switch tamping assembly with fully hydraulic tamping drive in front view, FIG. 2 shows a fully hydraulic switch tamping assembly according to the invention with fully hydraulic tamping drive in front view, FIG. 3 shows a conventional switch tamping assembly on the left and one designed according to the invention on the right in a partially sectional side view, FIG. 4 shows a conventional switch tamping assembly on the left and one according to invention on the right in front view, FIG. 5 shows a pick arm in the conventional design on the left and an embodiment according to the invention on the right in an oblique view, FIG. 6 shows a pick holder in conventional design on the left and an embodiment according to the invention on the right in an oblique view and FIG. 7 shows the embodiment of the conventional pick arm bearing on the left and the embodiment according to the invention on the right in cross-section.

BRIEF DESCRIPTION OF THE PREFERRED EMBODIMENTS

FIG. 1 shows a conventional switch tamping assembly 1 with guide columns 2 on which the tamping box slides up and down as support 3 for the tamping tools. The pick arm 5 is hinged to the pivot bearing 7 and the pick holder 8 so that the picks 9 can be pivoted upwards. Reference numeral 6 shows the rotary pivot drives. Via the fully hydraulic tamping drive 4, the pick arm is closed during tamping with simultaneous superimposed vibration.

FIG. 2 schematically shows a switch tamping assembly 1 according to the invention with guide columns 2 on which the tamping box slides up and down as a support 3 for the tamping tools. The pick arm 5 is articulated to the pick holder 17 and the pick holder 16 so that the picks 9 can be pivoted upwards by means of the pivot drive 6. The fully hydraulic tamping drive 4 closes the pick arm during tamping with simultaneous superimposed vibration. Reference numeral 25 shows the console to which the tamping drive 4 is connected. The hydraulic drive 4 engages at one end on the pick arm 5, 10 and at the other end on the support 3 via a bearing block 25. This bearing block 25 is manufactured separately and then connected to the support 3. This allows the use of the tamping assembly 1 according to the invention also with differently designed tamping drives (e.g. eccentric drives).

FIG. 3 schematically shows on the left side the design of a conventional pick arm 14 with articulated pivot bearing and pick holder as seen from the left side and on the right side the design 15 according to the invention with two pick holders 16, 17. FB shows the point of force introduction of the tamping drive 4. FB shows the reaction forces which occur at the pick plates of the pick during tamping. In the conventional design 14, the closing force FB is disadvantageously asymmetrically introduced into the pick arm bearing at a distance a. With the design according to the invention, the closing force is introduced in exactly the same plane, so that no parasitic forces and moments occur. The picks 9 of the tamping assemblies 14, 15 penetrate the ballast bed at high speed and are then strongly braked. The submerged impact forces FS that occur place a high load on the components pick arm 10*a*, 10*b*, pivot bearing 7 and pick holder 8, 16, 17 of the pivot drives 6*a*, 6*b* and the bearings 11*a*, 11*b*, 13*a*, 13*b*. In the conventional design 14, these impact forces FS are primarily introduced into the vertical guides via a much larger moment arm b than in the design c according to the invention. The acting moments and the stress on the tamping box 3 and the vertical guides 2 are thus considerably higher in the conventional design 14 than in the system 15 designed according to invention. As a result, the switch tamping assembly 15 designed according to the invention is stressed by considerably lower moments and forces. This increases the service life of the individual components and bearings and reduces wear.

FIG. 4 shows on the left the conventional pick arm 14 with attachments in front view and on the right the design 15 according to the invention. FB shows the combined closing and vibration force of the tamping drive acting on the pick arm. Reference numerals 6*a* and 6*b* show the pivot drives. Reference numeral 7 is designated the adjusting bearing and reference numeral 8 the pick holder. The designation adjusting bearing 7 refers to the fact that the shaft is pressed into the adjusting bearing of component 7 and rotates with it during pivoting. Slide bushes are therefore installed in pick arm 5*a* and also in the pick holder 8 which rotates on the shaft of the pivot bearing 7. In the design 15 according to the invention, the pick holder 16 of the outer pick and the pick holder 17 of the inner pick sit side by side on a fixed shaft which is pressed into the pick arm 5*b*. The pick arms are mounted in the pick box 3 via 11*a* and 11*b*. FS indicates the plunge impact forces and FP indicates the pick compaction forces. The surface pressures are essential for the wear of the bushes. SL shows schematically the surfaces in which the axis is pressed in. PH schematically shows the surface area of the slide bushes of pick holder 8. The size of the surfaces of the two pick holders PH1 and PH2 of the design according to the invention are firstly equal and secondly considerably larger than in the conventional design PH. This means that with the design 15 according to the invention, considerably lower surface pressures occur with the same acting forces, which is associated with correspondingly reduced wear.

FIG. 5 shows schematically on the left a pick arm in the conventional design 5*a* with two diverging webs and a design according to the invention of the pick arm 5*b* with only one central web in the right picture.

FIG. 6 schematically shows on the left an adjusting bearing 7 and a pick holder 8 in conventional design which rotates on the axis fixed in the pivot bearing 7 and a design according to the invention of pick holders 16, 17 for the inner and outer pick. The pick holders 16 and 17 are designed as identical components. 17 corresponds to 16 rotated by 180° around the vertical axis. The pick holders 16 and 17 sit next to each other and rotate on an axis fixed in the pick arm 5*b*.

FIG. 7 schematically shows on the left the design of the conventional pivot bearing of the pick arm and on the right the much simpler design of the pivot bearing of the pick arm according to the invention. The pick arm 5 in the conventional version is designed with two webs and is connected via a bush 20 and spacers 22 to the eye of the pick box 3 with the aid of a bolt 18 and bolted 23. To prevent the lubricating oil from escaping, radial seals 21 are fitted to the left and right of the bearing and are fixed with spacer covers 19. The design according to the invention has the single web pick arm 5 in the middle around which the eyes of the picking box 3 close. The pick arm 5 is bolted to the picking box 3 by means of the bolt 18 via lubricant-free slide bushes 20 and spacers 24.

The invention claimed is:

1. A tamping assembly for a track-tamping machine, said tamping assembly comprising:

tamping tools pivotally adjustably arranged on a support guided in a tamping assembly frame in vertically adjustable movement;

said tamping tools being rocker arm pairs having lower tamping pick ends configured to be inserted in a ballast bed;

the lower tamping pick ends being driven in opposite directions or synchronously by an oscillating drive comprising a hydraulic drive, and being hydraulically closeable relative to one another;

wherein each tamping tool has a respective pick arm mounted on the support so as to be pivotally adjustable about a respective pivot axis, each pick arm having one end that the hydraulic drive engages and another end to which at least one pick is attached; and wherein each of the pick arms has a single web configuration and has a single web that extends along a longitudinal axis of the pick arm and is mounted on the pivot axis between two axis supports associated with the support; and wherein a pick holder is provided between the pick arm and the pick, said pick holder being mounted on the pick arm so as to be pivotable about an adjustment axis by a pivot drive;

wherein the adjustment axis is perpendicular to the pivot axis, and a connection of the hydraulic drive with the pick arm, the longitudinal axis of the pick arm, and the adjustment axis lie in a common plane extending between the two axis supports of the support.

2. A tamping assembly according to claim 1, wherein at least two of said pick holders mounted on the pick arm so as to be pivotally adjustable about the adjustment axis are associated with each pick arm, said pick holders being constructed as identical parts.

3. A tamping assembly according to claim 2, wherein said pick holders are mounted so as to be pivotally adjustable by means of slide bushes on the adjustment axis, which is arranged in a rotationally fixed manner in the pick arm.

4. A tamping assembly according to claim 2, wherein pivot or adjustment axes are associated with lubricant-free slide bushes made of plastic, composite material or carbon fiber.

5. A tamping assembly according to claim 1, wherein the pivot or adjustment axes are associated with lubricant-free slide bushes made of plastic, composite material or carbon fiber.

6. A tamping assembly according to claim 1, wherein the hydraulic drive acting at one end on the pick arm acts at the other end on the support via a bearing block.

7. A tamping assembly for a track-tamping machine, said tamping assembly comprising:

a support guided in a tamping assembly frame for vertically adjustable movement;

tamping tools supported on the support;

said tamping tools each including a respective pick arm each having two ends;

one of the ends of the pick arm having a pick holder supporting a pick, wherein said pick holder is mounted on the pick arm so as to be pivotable about an adjustment axis by a pivot drive, and wherein said pick forms part of a respective rocker arm pair of the respective tamping tool, said rocker arm pair having lower tamping pick ends configured to be inserted in a ballast bed and being supported so as to be hydraulically closeable relative to one another;

each of the pick arms being of single web design with a respective single web thereof extending along a longitudinal axis of the pick arm and positioned between two axis supports associated with the support such that each of the pick arms is pivotably mounted on the support for pivotally adjustable movement about a respective pivot axis on the support; and the other end of the pick arm having a connection with a hydraulic drive of an oscillating drive that drives the lower tamping pick ends of the rocker arm pairs of the tamping tools in opposite directions relative to each other or synchronously with respect to each other;

wherein the adjustment axis of the pick holder is perpendicular to the pivot axis of the associated pick arm; and wherein the connection of the hydraulic drive with the pick arm, the longitudinal axis of the pick arm in which the web extends, and the adjustment axis lie in a common plane that extends between the two axis supports of the support supporting the pick arm.

8. The tamping assembly according to claim 7, and further comprising at least one additional pick holder mounted on each of the pick arms so as to be pivotally adjustable about the adjustment axis thereof, said pick holders being constructed as identical parts.

9. The tamping assembly according to claim 8, wherein the pivot or adjustment axes are associated with lubricant-free slide bushes made of plastic, composite material or carbon fiber.

10. The tamping assembly according to claim 7, wherein the pivot or adjustment axes are associated with lubricant-free slide bushes made of plastic, composite material or carbon fiber.

11. The tamping assembly according to claim 7, wherein the hydraulic drive has one end acting at said end of the pick arm and another end that acts on the support via a bearing block.

12. The tamping assembly according to claim 7, wherein said pick holders are mounted so as to be pivotally adjustable using slide bushes positioned on the adjustment axis and rotationally fixed in the pick arm.

13. The tamping assembly according to claim 7, wherein the connection of the hydraulic drive with the pick arm includes a connection portion of the hydraulic arm being received between spaced portions of the pick arm both extending from the web of the pick arm so that the connection portion of the hydraulic drive is centered in said plane between the two axis supports.

* * * * *